United States Patent [19]

Poyer

[11] Patent Number: 4,787,018

[45] Date of Patent: Nov. 22, 1988

[54] OUTDOOR ELECTRIC LIGHTING FIXTURE

[76] Inventor: David D. Poyer, 858 Roseway St., Naples, Fla. 33942

[21] Appl. No.: 197,340

[22] Filed: May 23, 1988

[51] Int. Cl.[4] ..... F21S 5/00; F21S 1/10

[52] U.S. Cl. ..... 362/216; 362/260; 362/431

[58] Field of Search ..... 362/84, 152, 216, 260, 362/311, 363, 368, 431, 457

[56] References Cited

U.S. PATENT DOCUMENTS

| | | | |
|---|---|---|---|
| 2,679,578 | 5/1954 | Hanger | 362/260 |
| 2,764,670 | 9/1956 | Van Dusen | 362/431 |
| 3,222,509 | 12/1965 | Thedford | 362/431 |
| 3,775,608 | 11/1973 | Shaper et al. | 362/431 |
| 4,422,010 | 12/1983 | Hammer | 362/216 |
| 4,523,263 | 6/1985 | Poyer | 362/267 |
| 4,549,252 | 10/1985 | Ripley et al. | 362/216 |
| 4,564,890 | 1/1986 | Poyer | 362/216 |
| 4,667,278 | 5/1987 | Poyer | 362/267 |
| 4,692,848 | 9/1987 | Poyer | 362/216 |

FOREIGN PATENT DOCUMENTS

| | | | |
|---|---|---|---|
| 692325 | 8/1964 | Canada | 362/431 |
| 22400 | 4/1956 | Fed. Rep. of Germany | 362/431 |
| 995568 | 6/1965 | United Kingdom | 362/363 |
| 1402537 | 8/1975 | United Kingdom | 362/431 |

*Primary Examiner*—Ira S. Lazarus
*Assistant Examiner*—David G. Messer
*Attorney, Agent, or Firm*—Merrill N. Johnson

[57] ABSTRACT

A simple and economical outdoor electric lighting fixture whose housing is made of polyvinyl chloride. The fixture includes a U-shaped fluorescent lamp; a socket for the lamp; a 120 volt transformer; a flanged circular base plate supporting the socket and transformer; a polyvinyl chloride cylindrical housing having at its center an interior annular ring supporting the base plate; a polyvinyl chloride cylindrical post supporting the cylindrical housing; a cylindrical frosted lens surrounding the fluorescent lamp and resting on the flange of the base plate; and a domed end cap fitted over the upper end of the cylindrical lens.

2 Claims, 1 Drawing Sheet

OUTDOOR ELECTRIC LIGHTING FIXTURE

BACKGROUND AND SUMMARY OF THE INVENTION

The invention relates to a simply assembled and economical electric lighting fixture using a U-shaped fluorescent lamp and designed for rugged use out-of-doors particularly in areas adjacent to the sea.

My prior U.S. Pat. Nos. 4,564,890 and 4,692,848 disclosed two forms of lighting fixtures using U-shaped fluorescent lamps with housings mainly made of polyvinyl chloride. These patents disclosed the advantages of making lighting fixture housings intended for outdoor use out of polyvinyl chloride.

My present outdoor lighting fixture requires fewer components and its assembly requires less time than my earlier outdoor lighting fixtures. Its assembly requires no screws or O-rings to hold together its housing components, all of which are already manufactured in quantity and readily available at reasonable cost.

Simply put, the present outdoor lighting fixture includes a U-shaped fluorescent lamp, a socket for the lamp, a 120 volt transformer wired in series with the lamp, a flanged circular base plate for supporting the lamp socket and the transformer, a polyvinyl (PVC) cylindrical housing having at its center an interior annular ring for supporting the base plate; a PVC cylindrical post fitting into the lower end of the cylindrical housing to support the housing and its electrical components.

A cylindrical frosted lens surrounds the fluorescent lamp and rests upon the flange of the base plate. A domed PVC end cap is fitted over the upper end of the cylindrical lens and secured to it by waterproof sealing material.

The PVC domed end cap, cylindrical housing and the supporting post can be finished in a variety of colors to make an attractive and durable outdoor lighting fixture which is waterproof and weatherproof. It is impervious to intense sunlight and salt-ladened sea air.

BRIEF DESCRIPTION OF THE DRAWINGS

My outdoor lighting fixture is best described with reference to the drawings in which.

DETAILED DESCRIPTION OF A PREFERRED EMBODIMENT

Figure 1:
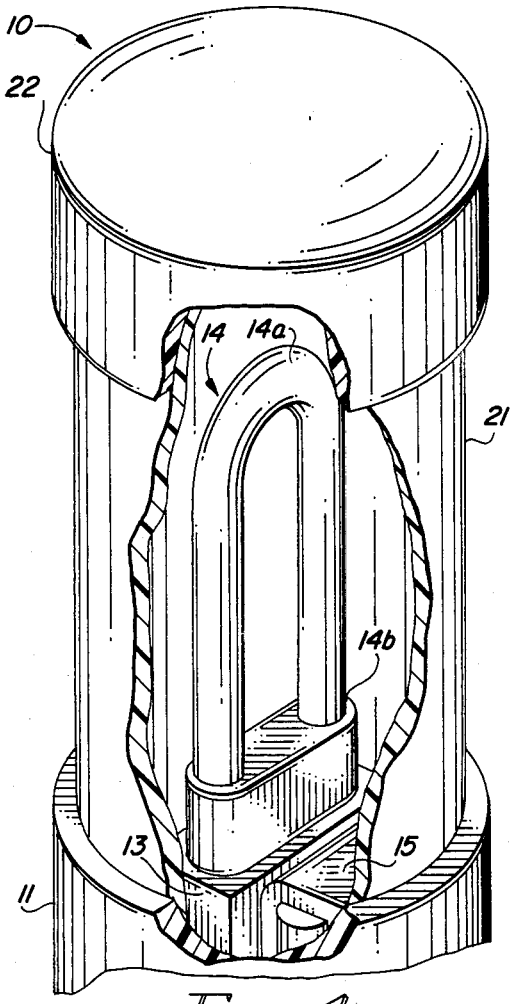
FIG. 1 is a perspective view partially broken away of the upper portion of a preferred embodiment of the outdoor lighting fixture.
Figure 2:
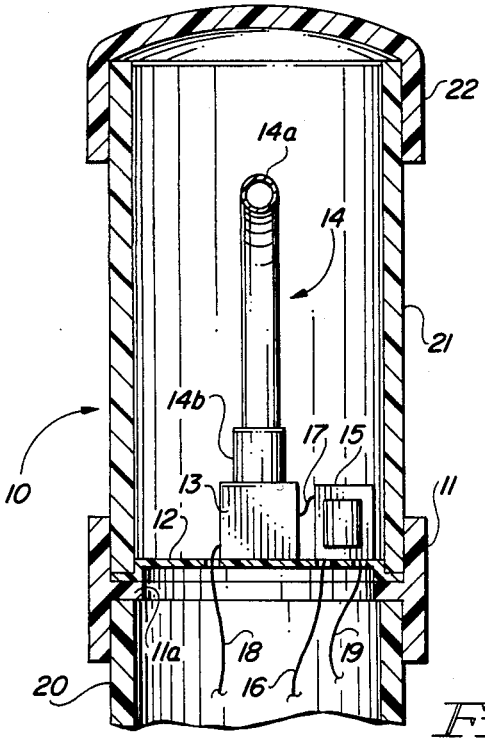
FIG. 2 is a cross-sectional side view of the lighting fixture shown in FIG. 1.
Figure 3:
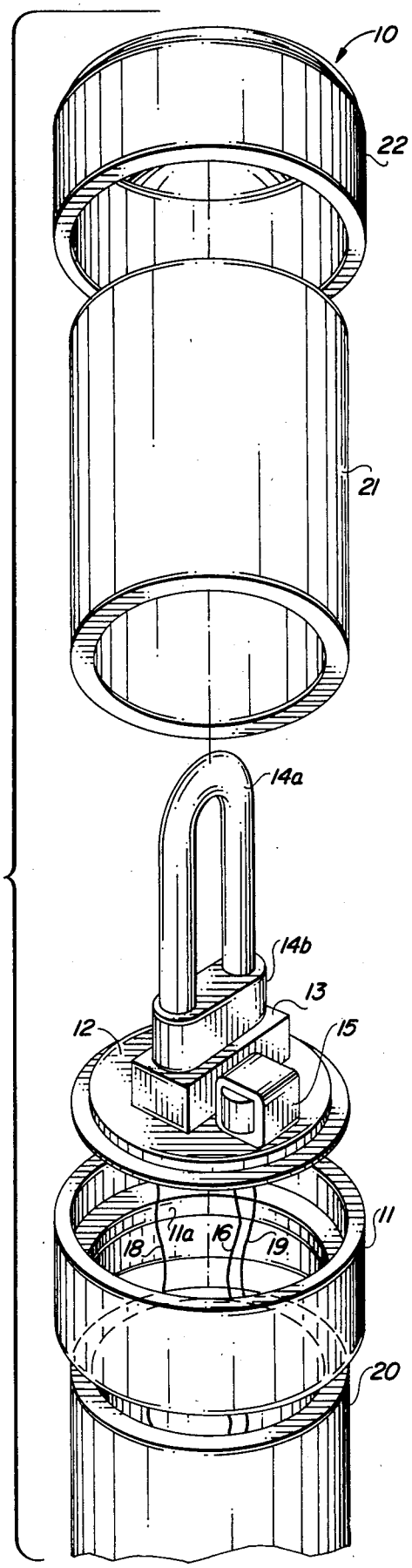
FIG. 3 is an exploded view of the lighting fixture shown in FIGS. 1 and 2.

Referring to FIGS. 1, 2 and 3 of the drawings, the assembled lighting fixture 10 includes a cylindrical housing 11 made of high density polyvinyl chloride (PVC) which has at its center a flat-edged annular ring 11*a* best shown in FIGS. 2 and 3 projecting from the housing's inner wall.

Housing 11 is supported on a cylindrical post 20 also preferably made of PVC. The outer diameter of post 20 is slightly less than the inner diameter of housing 11 and the lower flat edge of annular ring 11*a* rests securely on the upper end of post 20. If desired, the connection between housing 11 and post 20 can be secured by a suitably waterproof sealing material (not shown).

A fluorescent lamp assembly is mounted on a flat circular base plate 12 having an outer flange designed to rest upon the upper flat edge of annular ring 11*a* of housing 11. A fluorescent lamp socket 13 and a 120 volt transformer 15 are mounted on base plate 12 and a fluorescent lamp 14 is fitted into socket 13.

Fluorescent lamp 14 has a U-shaped fluorescent tube 14*a* and a bayonet type base 14*b* for insertion into socket 13. Transformer 15 and socket 13 are wired in series by wires 16, 17 and 18 as best shown in FIG. 2 and the base of transformer 15 is grounded by wire 19.

Fluorescent lamp 14 is protected and surrounded by a preferably frosted cylindrical lens 21. The outer diameter of lens 21 is slightly less than the inner diameter of housing 11 so that the lower end of the lens fits into the upper end of the housing with the bottom edge of the lens resting upon the upper flat edge of the flange of base plate 12 as best shown in FIG. 2. The upper end of lens 21 is closed by a domed end cap 22 preferably made of PVC which may be permanently bonded to the lens by a suitable waterproof sealing material (not shown).

Housing 11, post 20 and end cap 22 may be used in their naturally white color or may be finished in a suitable decorative color to enhance the appearance of the lighting fixture. In either event, the fixture provides a rugged and attractive lighting fixture for use out of doors which is particularly suited for use on docks and similar marine structures adjacent the sea.

While I have illustrated and described a preferred embodiment of my novel outdoor lighting fixture, those skilled in the art will be able to make changes and modifications without departing from the spirit of the invention. No limitation should be implied from the foregoing description since the scope of the invention is set forth only in the appended claims.

I claim:

1. A lighting fixture designed for outdoor use comprising:

a U-shaped fluorescent lamp;

a socket for the fluorescent lamp;

a 120 volt transformer;

a flanged circular base plate supporting the socket and the transformer;

a cylindrical housing made of polyvinyl chloride having at its center an interior annular ring supporting the base plate;

a cylindrical post whose outer diameter is slightly less than the inner diameter of the housing for supporting the housing and whose upper edge rests against the annular ring of the housing;

a cylindrical frosted lens surrounding the fluorescent lamp and resting upon the flange of the base plate; and a domed end cap fitted over the upper end of the cylindrical lens.

2. A lighting fixture as set forth in claim 1 wherein both the cylindrical post and the end cap are made of polyvinyl chloride.

* * * * *